United States Patent [19]

Forrest et al.

[11] 4,292,690

[45] Oct. 6, 1981

[54] METHOD OF MAKING A COMPOSITE FUR GARMENT

[75] Inventors: Michael R. Forrest; Alfred Kohn, both of New York, N.Y.

[73] Assignee: Michael Forrest, Inc., New York, N.Y.

[21] Appl. No.: 879,059

[22] Filed: Feb. 21, 1978

[51] Int. Cl.[3] ..... A41D 5/00; C14B 1/00

[52] U.S. Cl. ..... 2/65; 69/22; 112/401

[58] Field of Search ..... 2/65, 66, 243 R, 243 A, 2/243 B; 83/915; 69/22; 112/401; 428/16

[56] References Cited

U.S. PATENT DOCUMENTS

| | | | |
|---|---|---|---|
| 1,558,279 | 10/1925 | Post | 69/22 |
| 2,120,152 | 6/1933 | Post | 2/65 |
| 2,287,733 | 6/1942 | Fried | 2/65 |
| 2,845,788 | 8/1958 | Mitchell et al. | 2/65 |
| 3,074,073 | 1/1963 | Hak | 2/65 |
| 3,611,964 | 10/1971 | Piampiano | 69/22 X |
| 3,760,424 | 9/1973 | Leinoff | 69/22 X |
| 3,903,716 | 9/1975 | Duchon et al. | 2/65 X |

FOREIGN PATENT DOCUMENTS

| | | | |
|---|---|---|---|
| 2354721 | 1/1978 | France | 2/243 B |

OTHER PUBLICATIONS

"Advanced Fur Craftsmanship", Samuel Raphael, 1948, title pages and pp. 32–35, 60–61, 154–155 & 172–173.

*Primary Examiner*—Louis Rimrodt
*Attorney, Agent, or Firm*—Bertram Frank

[57] ABSTRACT

A composite fur garment and method of making same from a fur pelt. The garment consists essentially of alternating strips of fur and base material sewn together lengthwise to form a composite fur pelt. The alternating strips are oriented vertically so that the garment has vertical ribbing when worn by a human.

6 Claims, 8 Drawing Figures

METHOD OF MAKING A COMPOSITE FUR GARMENT

BACKGROUND OF THE INVENTION

1. Field of the Invention

A garment formed from a composite fur pelt.

2. Description of the Prior Art

Mankind has valued fur garments, both for purposes of warmth and appearance, for many centuries. The earliest fur garments, used by stone age men during the ice ages and by American Indians up to the present time, were simply the rough fur skin of the animal, which may have been cured or otherwise treated for longevity of service. Thus everyone is familiar with the American Indian stereotype draped with a buffalo hide. In more sophisticated societies, a complex technology employing highly skilled craftsmen has evolved, to transform fur pelts into garments such as coats, stoles, capes, jackets, robes, hats, etc. In this regard it is interesting to note that exploration of North America by the white man was instigated to a great degree in order to procure beaver pelts for beaver hats, which were very popular in Europe a few generations ago. At the present time, the fur trade employs many workers and it is universally recognized that it is the wish and desire of virtually every woman to own at least one fur garment, preferably a mink coat or stole.

Thus, the fur commerce has evolved to the point where appearance of the garment is paramount, and numerous techniques have evolved to make fur garments more attractive, or to extend the available supply of pelts and to use every piece or scrap of fur pelt somewhere in the garment. Extension of the useful service life of fur garments is also a highly developed art, and cold storage of valuable fur garments in summertime to prevent insect attack etc. is widely practiced. Extension of the area of garment coverage attained by a given number of pelts is an evolving art. A composite fur pelt and method of making same and fur coat is described in U.S. Pat. No. 3,760,424.

SUMMARY OF THE INVENTION

1. Purposes of the Invention

It is an object of the present invention to provide an improved method of making a composite fur pelt.

Another object is to provide an improved composite fur garment.

A further object is to provide a fur pelt and garment with a ribbed effect.

An additional object is to extend fur in the area of coverage in a garment by providing a composite fur pelt.

Still another object is to make fur garments which are less bulky.

An object is to make a composite fur pelt which is more pliable to drape as a garment.

An object is to make a composite fur pelt and garment with a very attractive look of vertical ribbing.

These and other objects and advantages of the present invention will become evident from the description which follows.

2. Brief Description of the Invention

In the present invention, the method of making a composite fur pelt includes providing a fur pelt derived from a furbearing animal. The fur pelt as furnished includes a central area, a lateral portion on each side of the central area, a top portion, and a bottom portion.

The fur pelt is initially slitted with a plurality of rectilinear cuttings. A first and a second group of rectilinear cuttings are parallel slits on either side of the central area. Each of the first and second groups extend from the top portion to adjacent the bottom portion parallel to the lateral portions. A third and a fourth group of rectilinear cuttings are angular parallel slits in each lateral portion. Each of the third and fourth group of rectilinear cuttings extends upwards and outwards from the lower terminus of one of the first or second group of rectilinear cuttings. A fifth and sixth group of rectilinear cuttings are outer cuttings in the lateral portions of the fur pelt adjacent and parallel to the third and fourth group of rectilinear cuttings. The fifth and sixth group of rectilinear cuttings extend into the bottom portion of the fur pelt.

After slitting the fur pelt with the plurality of rectilinear cuttings, the fur pelt is stretched along the plurality of rectilinear cuttings so that the fur pelt is adjusted into a generally rectangular shaped pelt having a length greater than its width. Then the rectangular shaped pelt is sewed along the plurality of rectilinear cuttings, so that a rectangularly shaped pelt with structural integrity is formed with a length greater than its width.

The rectangularly shaped pelt is then sliced lengthwise into a plurality of generally equal sized strips of fur of uniform and equal width. A plurality of equal sized strips of base material is now provided. The base material may be leather, suede or the like. The fur strips and the base material strips are alternately sewed together side-by-side, so that a composite fur pelt is formed. The composite fur pelt is then cut to the shape of at least a portion of a garment, with the cut composite fur pelt being dimensioned to give generally vertical ribbing to the garment when worn by a human.

The fur pelt typically is the skin of a fur-bearing animal such as beaver, mink, sable, fisher or rabbit. The width of the fur strips typically is about 8 millimeters, while the width of the strips of base material typically is about 11/32 inch.

In a preferred embodiment, a second rectangularly shaped pelt with structural integrity is sewed end-to-end along its width to the first rectangularly shaped pelt with structural integrity, to form a combined rectangularly shaped pelt of about twice the length of the original rectangularly shaped pelt. The combined rectangularly shaped pelt is sliced lengthwise to form the plurality of generally equal size strips of fur of uniform and equal width. The strips of base material in this case would be about twice as long.

The invention thus contemplates a composite fur garment which includes alternating strips of fur and base material sewn together lengthwise and side-by-side to form a composite fur pelt. The composite fur garment has the alternating strips oriented vertically, so that the garment has vertical ribbing when worn by a human.

The present invention provides several salient advantages. An improved composite fur pelt and garment is provided, in which, when the garment is worn by a human, the ribbing is vertical. Thus an improved ribbed effect is attained in the composite fur pelt and garment. The area of coverage of a fur pelt in a garment is effectively extended. The present fur garment is less bulky. The composite fur pelt is more pliable to drape as a garment. A very attractive look of vertical ribbing is attained.

The invention accordingly consists in the features of construction, combination of elements, arrangement of parts and series of steps which will be exemplified in the method and article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
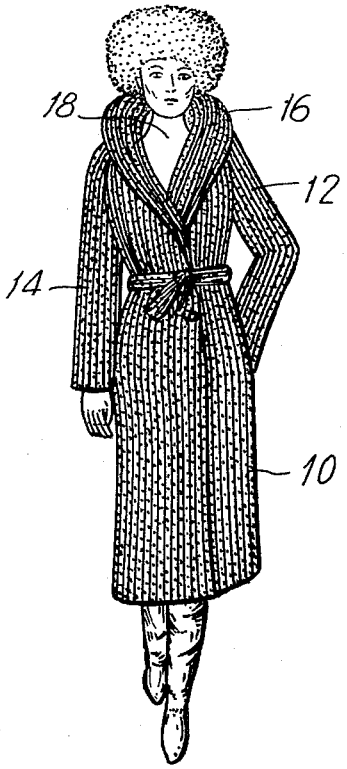
FIG. 1 is an elevation view of the present fur garment, in this case a coat, being worn by a woman.

Referring now to FIG. 1, a fur coat 10 of the present invention is very pleasing and attractive to the eye by virtue of the vertical ribbing and a vertically ribbed effect, which extends to the arms 12 and 14 and lapel 16, and which accentuates the height and slimness of the woman 18. In other words, the vertical ribbing effect tends to make the woman 18 appear slimmer and taller than she actually is.

Figure 2:
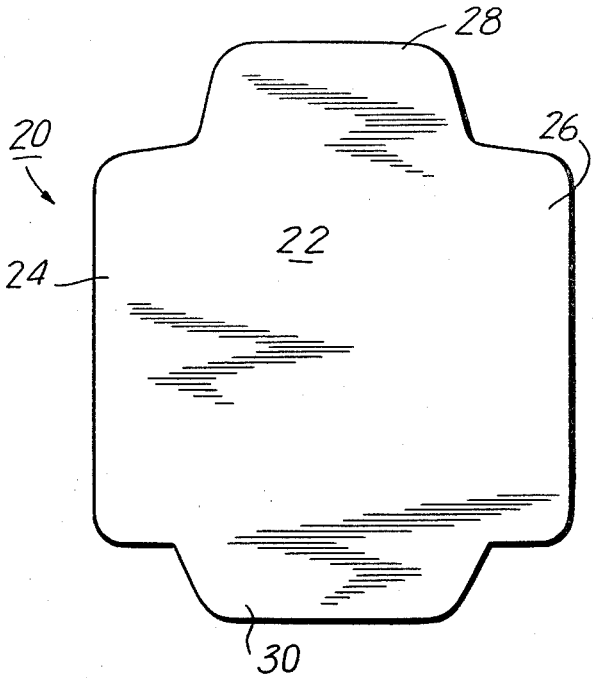
FIG. 2 is a plan view of the original fur pelt as furnished to the furrier.

FIG. 2 shows the original fur pelt 20 with central area 22, two opposed lateral portions 24 and 26 on either side of the central area 22, a top portion 28 and a bottom portion 30. The general configuration of the fur pelt 20 is basically that of the skin of the original animal from which the pelt is derived.

Figure 3:
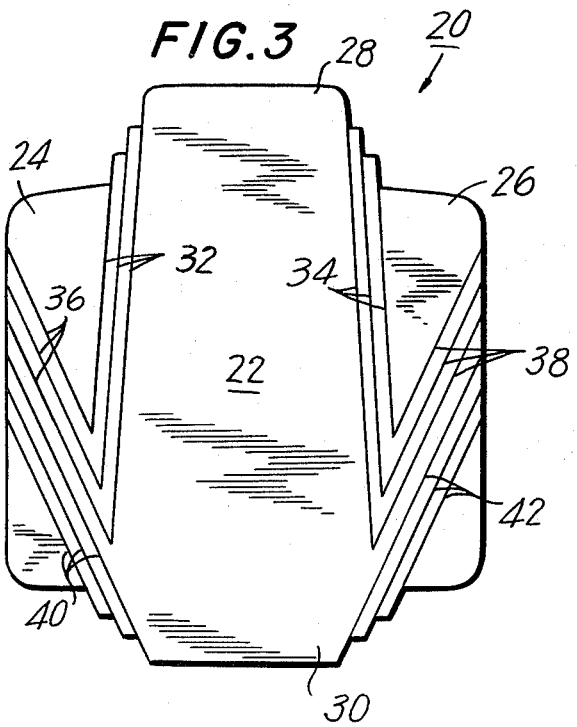
FIG. 3 is a plan view showing the pelt of FIG. 2 after slitting with a plurality of rectilinear cuttings.

FIG. 3 shows the fur pelt 20 after slitting with a plurality of rectilinear cuttings. A first group 32 and a second group 34 of rectilinear cuttings are parallel slits on either side of the central area 22. The cuttings 32 and 34 extend from the top portion 28 to adjacent the bottom portion 30 and parallel to the lateral portions 24 and 26 resepctively. A third group 36 and a fourth group 38 of rectilinear cuttings are angular parallel slits in each lateral portion 24 and 26 respectively. Each cuttings group 36 or 38 extends upwards and outwards from the lower terminus of the respective first or second group 32 or 34. A fifth group 40 and a sixth group 42 of rectilinear cuttings are outer cuttings in the lateral portions adjacent and parallel to, respectively, the third group 36 and the fourth group 38. The cuttings groups 40 and 42, as shown, extend into the bottom portion 30.

Figure 4:
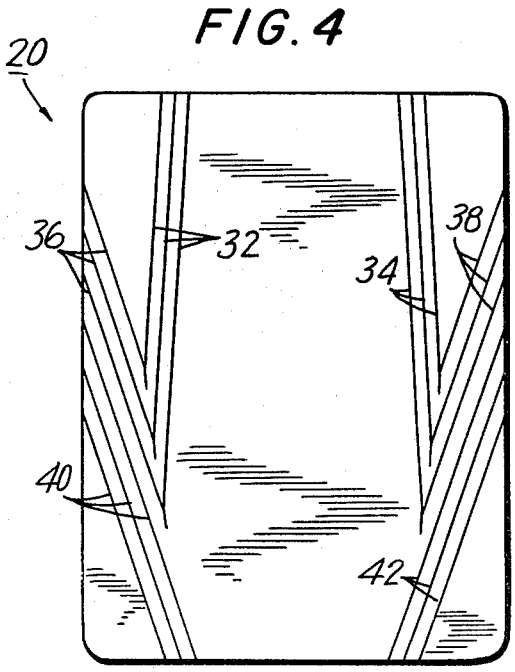
FIG. 4 is a plan view showing the pelt of FIG. 3 after stretching of the pelt into a rectangular configuration.
Figure 5:
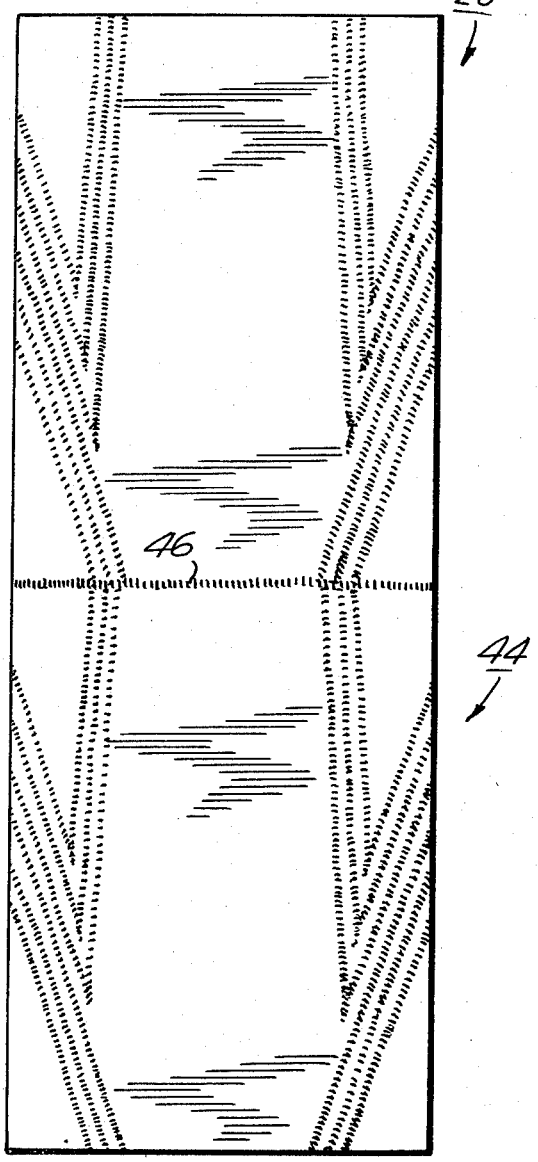
FIG. 5 shows two rectangularly shaped pelts sewn together endwise along their width.

FIG. 4 shows the pelt 20 as a substantially rectangular shaped pelt having a length greater than its width, which has been formed by stretching the fur pelt of FIG. 3 along the plurality of rectilinear cuttings so that the dimension of the fur pelt 20 has been adjusted. At this point, the adjusted rectangular shaped pelt 20 is sewed along the plurality of rectilinear cuttings, so that a rectangularly shaped pelt with structural integrity is formed. Such a pelt 20 is shown in FIG. 5 in conjunction with another similar pelt 44. The two rectangularly shaped pelts 20 and 44 having structural integrity as evidenced by the lines of sewing shown in FIG. 5 have been sewed end-to-end along their widths at line 46. Thus a combined rectangularly shaped pelt 20 plus 44 of about twice the length of each individual rectangular pelt is formed.

Figure 6:
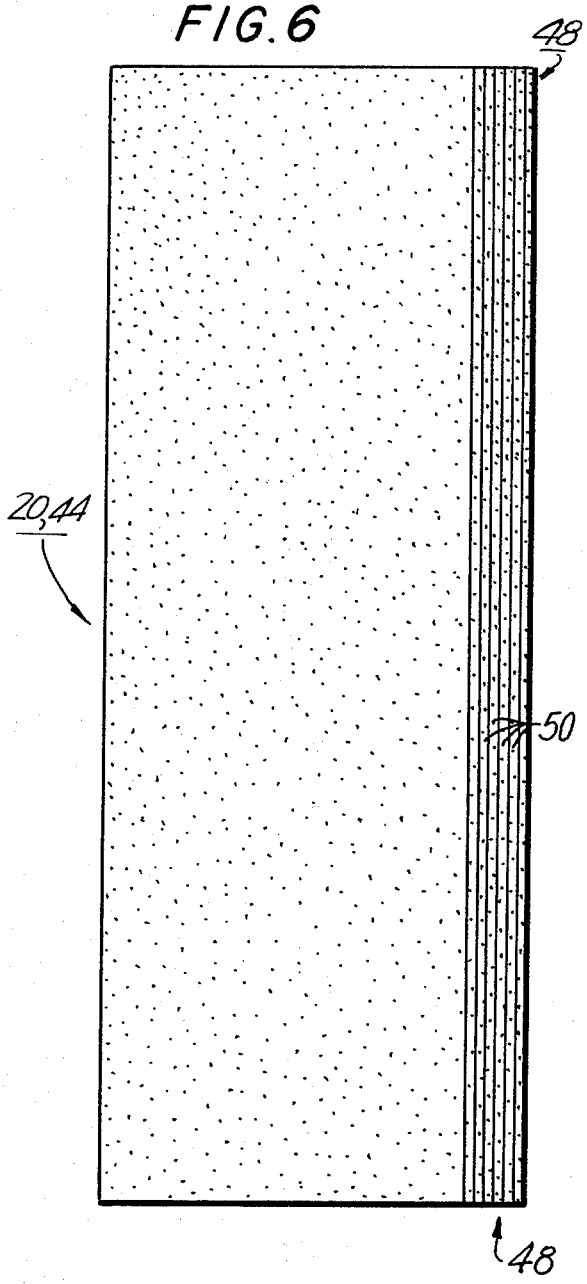
FIG. 6 shows the slicing of the pelt of FIG. 5 into a plurality of substantially equal sized strips of fur of uniform and equal width.
Figure 7:
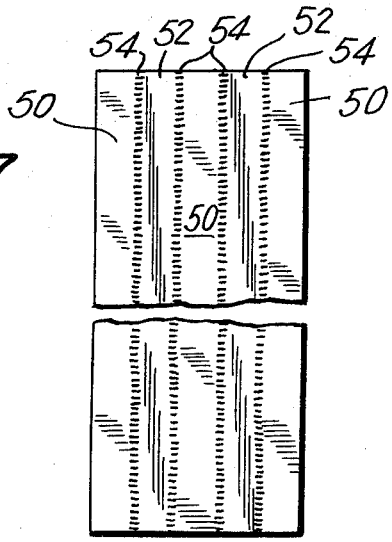
FIG. 7 shows the sewn together alternate strips of fur and base material in side-by-side relationship to form a composite pelt.
Figure 8:
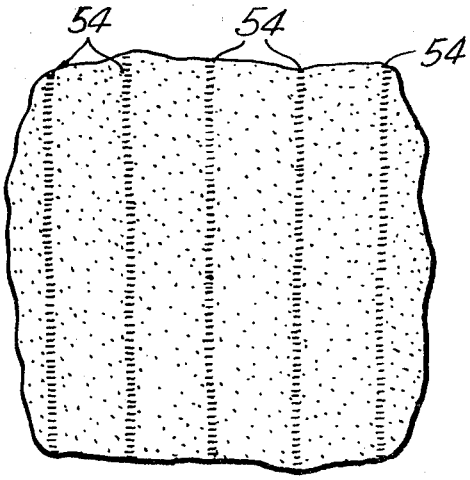
FIG. 8 is a detail of the composite fur pelt.

FIG. 6 shows the fur side of the combined pelt of FIG. 5, with the combined rectangular pelt 20, 44 being sliced lengthwise at 48—48 into a plurality of generally equal sized strips 50 of fur of uniform and equal width. FIG. 7 shows alternate strips of fur 50 and base material 52, sewn together side-by-side by sewing 54. Thus a composite fur pelt has been formed, which as shown in FIG. 8 has a continuous fur appearance on the opposite side to FIG. 7. In other words, the base material strips 52 shown in FIG. 7 are not visible when the composite fur pelt is turned around to the opposite side as in FIG. 8, but instead a continuous fur surface with ribbing is visible, because the fur of the fur strips overlaps the base material strips.

It thus will be seen that there is provided a method of making a composite fur pelt and composite fur garment which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A method of making a composite fur pelt which comprises the steps of:

(a) providing a fur pelt having a central area, a lateral portion on each side of said central area, a top portion and a bottom portion;

(b) slitting said fur pelt with a plurality of rectilinear cuttings as follows:

(1) a first and second group of rectilinear cuttings consisting of a series of parallel slits in and on either side of the central area of said pelt extending from the top portion to adjacent the bottom portion of said pelt, said slits being oriented substantially parallel to said lateral portions;

(2) a third and fourth group of rectilinear cuttings consisting of a series of angular parallel slits in each of said lateral portions, each of said third and fourth group of rectilinear cuttings extending upwards and outwards from the lower terminus of one of said first or second group of rectilinear cuttings;

(3) a fifth and sixth group of rectilinear cuttings consisting of a series of cuttings in said lateral portions adjacent and parallel to said third and fourth group of rectilinear cuttings but lying outside thereof said fifth and sixth group of rectilinear cuttings extending into said bottom portion of said pelt;

(c) stretching said fur pelt along said plurality of rectilinear cuttings so that said fur pelt is adjusted into a substantially rectangular shaped pelt having a length greater than its width;

(d) sewing said rectangular shaped pelt along said plurality of rectilinear cuttings so that a rectangularly shaped pelt with structural integrity is formed with a length greater than its width;

(e) slicing said rectangularly shaped pelt lengthwise into a plurality of substantially equal sized strips of fur of uniform and equal width;

(f) providing a plurality of equal sized strips of base material;

(g) alternately sewing together side-by-side fur strips and said base material strips, so that a composite fur pelt is formed, said base material being of a thickness and width so that the fur in said fur strips overlaps said base material strips and renders said base material strips invisible;

(h) cutting said composite fur pelt to the shape of at least a portion of a garment, the cut composite fur pelt being dimensioned to give a substantially continuous fur surface with vertical ribbing to said garment when worn by a human.

2. The method of making a composite fur pelt of claim 1 in which the fur pelt is a skin selected from the group consisting of beaver, mink, sable, fisher and rabbit.

3. The method of making a composite fur pelt of claim 1 in which a second rectangularly shaped pelt with structural integrity is sewed end-to-end along its width to said rectangularly shaped pelt with structural integrity to form a combined rectangularly shaped pelt of about twice the length of said rectangularly shaped pelt, and said combined rectangularly shaped pelt is sliced lengthwise to form said plurality of substantially equal sized strips of fur of uniform and equal width.

4. The method of making a composite fur pelt of claim 1 in which the width of the fur strips is about 8 millimeters.

5. The method of making a composite fur pelt of claim 1 in which the width of the strips of base material is about 11/32 inch.

6. The method of making a composite fur pelt of claim 1 in which the base material is selected from the group consisting of leather and suede.

* * * * *